US006394212B1

(12) United States Patent
Takano et al.

(10) Patent No.: US 6,394,212 B1
(45) Date of Patent: May 28, 2002

(54) ROTARY TYPE CONSTRUCTION MACHINE AND CAB, EQUIPMENT HOUSING COVER AND COUNTERWEIGHT FOR SUCH CONSTRUCTION MACHINE

(75) Inventors: Yutaka Takano, Ibaraki; Yasuo Hayakawa, Tsukuba; Hideo Hokari, Toride; Kazutaka Tateishi, Tsuchiura, all of (JP)

(73) Assignee: Hitachi Construction Machinery Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,713

(22) PCT Filed: Dec. 2, 1998

(86) PCT No.: PCT/JP98/05437

§ 371 (c)(1),
(2), (4) Date: Aug. 20, 1999

(87) PCT Pub. No.: WO99/32734

PCT Pub. Date: Jul. 1, 1999

(30) Foreign Application Priority Data

Dec. 22, 1997 (JP) ..... 9/365793

(51) Int. Cl.[7] ..... B62D 33/06; B32B 5/16; B32B 27/00; B05D 1/36

(52) U.S. Cl. ..... 180/89.13; 428/323; 428/421; 428/425.9; 428/425.5; 427/409; 521/905

(58) Field of Search ..... 180/89.13; 280/755, 280/757, 759; 428/323, 331, 425.9, 425.5, 423.1, 457, 421; 427/409; 521/905; 106/31.6, 481, 482, 487, 493

(56) References Cited

U.S. PATENT DOCUMENTS

| | | | | | |
|---|---|---|---|---|---|
| 4,396,672 | A | * | 8/1983 | Adesko | 428/323 |
| 4,596,724 | A | * | 6/1986 | Lane et al. | 427/385.5 |
| 4,907,667 | A | * | 3/1990 | Yamamoto et al. | 180/89.13 |
| 5,016,721 | A | * | 5/1991 | Yamamoto et al. | 180/89.13 |
| 5,075,165 | A | * | 12/1991 | Kishi et al. | 428/331 |
| 5,199,193 | A | * | 4/1993 | Akiba et al. | 180/89.13 |
| 5,330,882 | A | * | 7/1994 | Kawaguchi et al. | 430/327 |

(List continued on next page.)

FOREIGN PATENT DOCUMENTS

| | | | | | |
|---|---|---|---|---|---|
| JP | 538632 | A | * | 1/1978 | C09D/5/00 |
| JP | 62115073 | A | * | 5/1987 | C09D/5/20 |
| JP | 62171794 | A | * | 7/1987 | C02F/3/10 |
| JP | 63242381 | A | * | 10/1988 | B05D/7/14 |
| JP | 1115968 | A | * | 5/1989 | C09D/5/00 |
| JP | 747329 | A | * | 2/1995 | B05D/7/14 |

(List continued on next page.)

*Primary Examiner*—Brian L. Johnson
*Assistant Examiner*—Joselynn Y. Sliteris
(74) *Attorney, Agent, or Firm*—Antonelli, Terry, Stout & Kraus, LLP

(57) ABSTRACT

A hydrophilic film coating (11) is formed on outer surfaces of cab (5), equipment housing cover (6) and counterweight (7) of an upper rotary body (2), so that a water film (18) is formed on the surface of the hydrophilic film coating by raindrops or at the time of rainfall. By formation of the water film (18), contaminant substances (13) which have deposited on the outer surfaces of the upper rotary body (2) are urged to float up and carried away with dripping water of the water film (18). As a consequence, it becomes possible to prevent development of raindrop stains on the outer surfaces of the upper rotary body (2) and, even if spattered particles of grease have deposited on the outer surfaces of the upper rotary body (2), such contaminants can be easily washed off, thereby permitting to maintain the quality in outer appearance of the upper rotary body (2).

21 Claims, 12 Drawing Sheets

U.S. PATENT DOCUMENTS 5,441,771 A * 8/1995 Seltmann et al. ..... 427/386
5,736,249 A * 4/1998 Smith et al. ..... 428/447
5,747,558 A * 5/1998 Nishi et al. ..... 523/201
5,880,173 A * 3/1999 Matsuda et al. ..... 523/122
5,931,247 A * 8/1999 Peterson ..... 180/89.13
5,985,454 A * 11/1999 McMordie et al. ..... 428/413
5,998,200 A * 12/1999 Bonaventura et al. ..... 435/264
5,998,541 A * 12/1999 Ogawa ..... 524/730
6,013,372 A * 1/2000 Hayakawa et al. ..... 428/411.1
6,013,724 A * 1/2000 Mizutani et al. ..... 524/588
6,045,903 A * 4/2000 Seino et al. ..... 428/331
6,048,910 A * 4/2000 Furuya et al. ..... 522/86
6,153,304 A * 11/2000 Smith et al. ..... 428/425.5
6,159,547 A * 12/2000 McMordie et al. ..... 427/409
6,170,588 B1 * 1/2001 Irino et al. ..... 180/89.13

FOREIGN PATENT DOCUMENTS

JP 753661 A * 2/1995 ..... C08G/18/48
JP 7166100 A * 6/1995 ..... C09D/5/02
JP 84238 A * 1/1996
JP 84246 A * 1/1996 ..... E04F/13/12
JP 84247 A * 1/1996 ..... E04F/13/12
JP 93397 A * 1/1997 ..... C09D/141/00
JP 9-225386 9/1997

* cited by examiner

ROTARY TYPE CONSTRUCTION MACHINE AND CAB, EQUIPMENT HOUSING COVER AND COUNTERWEIGHT FOR SUCH CONSTRUCTION MACHINE

TECHNICAL FIELD

This invention relates to a rotary type construction machine such as hydraulic power shovel, hydraulic crane or the like, and also to cab, equipment housing cover and counterweight for such a construction machine.

BACKGROUND ART

Generally, rotary type construction machines such as hydraulic power shovels and hydraulic cranes are constituted by a self-propelled base carrier and a rotary body which is mounted on the base carrier, and a working mechanism which is mounted on a front portion of the rotary body to carry out, for example, ground excavating operations or other ground working operations.

As a typical example of conventional rotary type construction machines, a hydraulic power shovel is roughly described below with reference to FIGS. 13 through 20.

In FIG. 13, indicated at 101 is a crawler type base carrier, and at 102 is an upper rotary body which is rotatably mounted on the base carrier 101.

A working mechanism 103 which can be lifted up and down to excavate earth or to carry out other ground working jobs is mounted centrally on a front portion of the upper rotary body 102.

The upper rotary body 102 is largely constituted by a rotary frame 104, a cab 105 which is built on the rotary frame 104 to serve as an operator's room, an equipment housing cover 106 serving as a housing for an internal combustion engine (not shown) and other equipments which are mounted on the rotary frame 104, and a counterweight 107 which is provided at the rear end of the rotary frame 104.

In the case of a hydraulic power shovel of this sort, outer surfaces of the cab 105, equipment housing cover 106 and counterweight 107 of the upper rotary body 102 are usually coated with a weather-proof oil paint such as a polyurethane paint or the like.

In many cases, construction machines such as hydraulic power shovels are normally stored in a roofless storage place, exposed to rain or other weather conditions, particularly during a period between final assembling and shipment. While being stored in such a way in an outdoor storage place, the painted surfaces of the cab 105, equipment housing cover 106 and counterweight 107 of the upper rotary body 102 are beaten by rains and degraded considerably by development of a large number of streaky stains 108 (hereinafter referred to as raindrop stains 108) on vertical portions of the coated surfaces as shown in FIG. 14.

Reference is now had to FIGS. 15 and 16, which show on an enlarged scale the encircled portion A in FIG. 14, for the explanation of the conditions of the coating and raindrop stains 108 on the outer surface of the equipment housing cover 106.

As shown in these figures, an under coat 110 of an anti-corrosive alkyd or urethane resin paint is formed on the outer surface of a steel plate 109 which constitutes the equipment housing cover 106, and a top or finishing coat 111 is formed on the surface of the under coat 110. In this regard, the top coat 111 is normally formed by the use of a water repellent oil paint for protection against rains, for example, by a solid paint such as acrylic resin paint, polyurethane paint or the like. Namely, the top coat 111 is formed by applying a solid paint on the under coat 110.

The above-mentioned raindrop stains 108 are formed by fine particles of oily contaminant substances 112, such as carbon compounds in exhaust gases of an internal combustion engine and spattered particles of grease coming from bearings of the working mechanisms 103, which are trapped by raindrops and flow down with rain drops along the surface of the top coat 111 of a side plate 106A, leaving thereon streaky stains.

The raindrop stains 108 are formed through a number of stages as explained below in greater detail with reference to FIGS. 17 to 20.

Firstly, as shown in FIG. 17, fine particles of contaminant substances 112, such as carbon compounds in exhaust gases and spattered particles of grease, fall and deposit on the surface of the top coat 111 which is formed on the outer surface of a top plate 106B of the equipment housing cover 106.

Nextly, as shown in FIG. 18, raindrops 113 which have fallen on the top coat 111 of the top plate 106B temporarily dwell thereon substantially in the form of semispherical mound-like water drops as indicated at 114. Therefore, the deposited particles of contaminant substance under the water drops 114 tend to float up off the surface of the top coat 111. At this time, since the top coat 111 is of a water-repellent oil paint, the water drops 114 sit on the surface of the top coat 111 with a large contacting angle $\theta 1$, for example, with a contacting angle $\theta 1$ larger than 80 degrees.

Then, as shown in FIGS. 19 and 20, the raindrops 114 on the top coat 111 are connected with each other to form a water pool 115, which then starts dripping from the top plate 106B along the side plate 106A together with particles of the contaminant substances 112 which are entrained on dripping water drops 116. At this time, particles of the contaminant substances 112 which float on the surfaces of the dripping water drops 116, stick to the surface of the top coat 111 along the dripping courses of the water drops 116.

Consequently, particles of the contaminant substances 112 deposit and accumulate on the outer surface of the side plate 106A in streaks along the courses of dripping water drops 116, forming a large number of raindrop stains 108 thereon as a result of repetition of the above-described contaminant deposition mechanism.

As explained above, due to the lipophilic property of the top coat 111 which covers the outer surface of the equipment cover 106, the raindrop stains 108 are easily formed by aggregated deposition of the oily contaminant substances 112. The raindrop stains of this sort are difficult to wash off with water, and detrimental particularly to the construction machine rental business because degradations in outer appearance quality will lower the value of the merchandise to a considerable degree.

DISCLOSURE OF THE INVENTION

In view of the problems of the prior art as described above, it is an object of the present invention to provide a rotary type construction machine, and a cab, an equipment housing cover and a counterweight for the rotary type a construction machine, which have outer surfaces less susceptible to deposition of contaminants and which permit to wash off stains of deposited contaminants very easily, if any, to maintain the quality in outer appearance of a rotary body of the construction machine for a prolonged period of time.

In accordance with the present invention, the above-stated objective is achieved by the provision of a rotary type construction machine having a self-propelled base carrier and a rotary body rotatably mounted on said base carrier, which is characterized in that a hydrophilic film coating is provided on outer surfaces of the rotary body.

With the arrangements just described, raindrops or sprinkled wash water falling on the outer surfaces of the rotary body come into intimate contact with the hydrophilic film coating and form a water film on the surface of the hydrophilic film coating. As a consequence, stains of oily contaminants which have deposited on the outer surfaces of the rotary body are urged to float up on the water film and can be easily removed along with the water film as it flows down on and along the outer surfaces of the rotary body.

The above-mentioned hydrophilic film coating according to the present invention is preferred to be provided at least on vertically disposed outer surfaces of the rotary body. By this arrangement, oily contaminants which have deposited on outer surfaces of the rotary body are urged to flow down with the water film which is formed on vertical outer surfaces of the rotary body. It follows that the deposited contaminants can be easily removed along with raindrops or sprinkled wash water which form the water film.

The hydrophilic film coating can be formed by the use of a hydrophilic coating agent which is coated on outer surfaces of the rotary body and is capable of forming a water film to float up and wash away therewith stains or contaminants deposited on outer surfaces of the rotary body. By this arrangement, oily contaminants which have deposited on outer surfaces of the rotary body can also be easily removed since they are urged to float up on and flow down with a water film which is formed by raindrops or sprinkled wash water.

Further, the hydrophilic film coating according to the present invention is arranged to have a water contacting angle smaller than 60 degrees. By this arrangement, raindrops or sprinkled wash water falling on the surface of the hydrophilic film coating quickly comes into intimate contact with the hydrophilic film coating to form a water film thereon in an accelerated manner.

Further, according to the present invention, in a rotary type construction machine including a self-propelled base carrier, and a rotary body rotatably mounted on the base carrier and having a cab mounted thereon to serve as an operator's room, preferably a hydrophilic film coating is provided on outer surfaces of the cab. By this arrangement, oily contaminant substances which have deposited on outer surfaces of the cab can be easily removed along with a water film which is formed on and flowing down along the outer surfaces of the cab.

Further, according to the present invention, in a rotary type construction machine including a self-propelled base carrier, and a rotary body rotatably mounted on the base carrier and having an equipment housing cover to house therein an internal combustion engine along with other equipments of the construction machine, preferably a hydrophilic film coating is provided on outer surfaces of the equipment housing cover. By this arrangement, oily contaminant substances which have deposited on outer surfaces of the equipment housing cover can be easily removed along with a water film which is formed on and flowing down along the outer surfaces of the equipment housing cover.

Furthermore, according to the present invention, in a rotary type construction machine having a self-propelled base carrier, and a rotary body rotatably mounted on the base carrier and having a counterweight thereon, preferably a hydrophilic film coating is provided on outer surfaces of the counterweight. By this arrangement, oily contaminant substances which have deposited on outer surfaces of the counterweight can be easily removed along with a water film which is formed on and flowing down along the outer surfaces of the counterweight.

Moreover, in one preferred form of the present invention, the hydrophilic film coating is formed by coating a paint which contains a hydrophilic agent. By this arrangement, the hydrophilic film coating can be formed on outer surfaces of the rotary body simply by coating thereon a paint which is added with a hydrophilic agent.

Further, in another preferred form of the present invention, the hydrophilic film coating is formed by coating, on an under coat of the rotary body, a top coat of a solid paint which contains a hydrophilic agent. By this arrangement, the hydrophilic film coating can be formed on the outer surfaces of the rotary body simply by coating thereon, as a top coat, a solid paint which contains a hydrophilic agent.

Further, in still another preferred form of the present invention, the hydrophilic film coating is formed by coating, on a first top coat of the rotary body, a second top coat of a clear paint which contains a hydrophilic agent. By this arrangement, similarly the hydrophilic film coating can be formed on the outer surfaces of the rotary body simply by coating, as a second top coat, a clear paint which contains a hydrophilic agent.

Moreover, according to the present invention, in a cab which is mounted on a rotary frame of a construction machine and formed in a cab cover structure having front and rear plates, right and left side plates and a top plate, a hydrophilic film coating is provided at least on outer surfaces of the front and rear plates and the right and left side plates of the cab cover structure. With this arrangement, even if oily contaminant substances have deposited on outer surfaces of the cab while in use, for example, such contaminant substances can be easily removed along with a water film which is formed on the outer surfaces of the cab by sprinkled wash water or the like.

Further, according to the present invention, in an equipment housing cover which is mounted on a rotary frame of a construction machine and formed in a housing structure including at least right and left side plates and a top plate located between upper ends of the side plates, a hydrophilic film coating is provided at least on outer surfaces of the right and left side plates. With this arrangement, even if oily contaminant substances have deposited on outer surfaces of the equipment housing cover while in use, for example, such contaminants can be easily removed along with a water film which is formed on the outer surfaces of the equipment housing cover upon sprinkling wash water or the like.

Furthermore, according to the present invention, in a counterweight which is provided on a rotary frame and in the form of a mass of a shape having at least front, rear, top and bottom sides, a hydrophilic film coating is provided on outer surfaces of the counterweight at least on outer surfaces on the rear side thereof. With this arrangement, even if oily contaminant substances have deposited on outer surfaces of the counterweight while in use, for example, such contaminants can be readily removed along with a water film which is formed on the outer surfaces of the counterweight upon sprinkling wash water or the like.

BEST MODE FOR CARRYING OUT THE INVENTION

Figure 1:
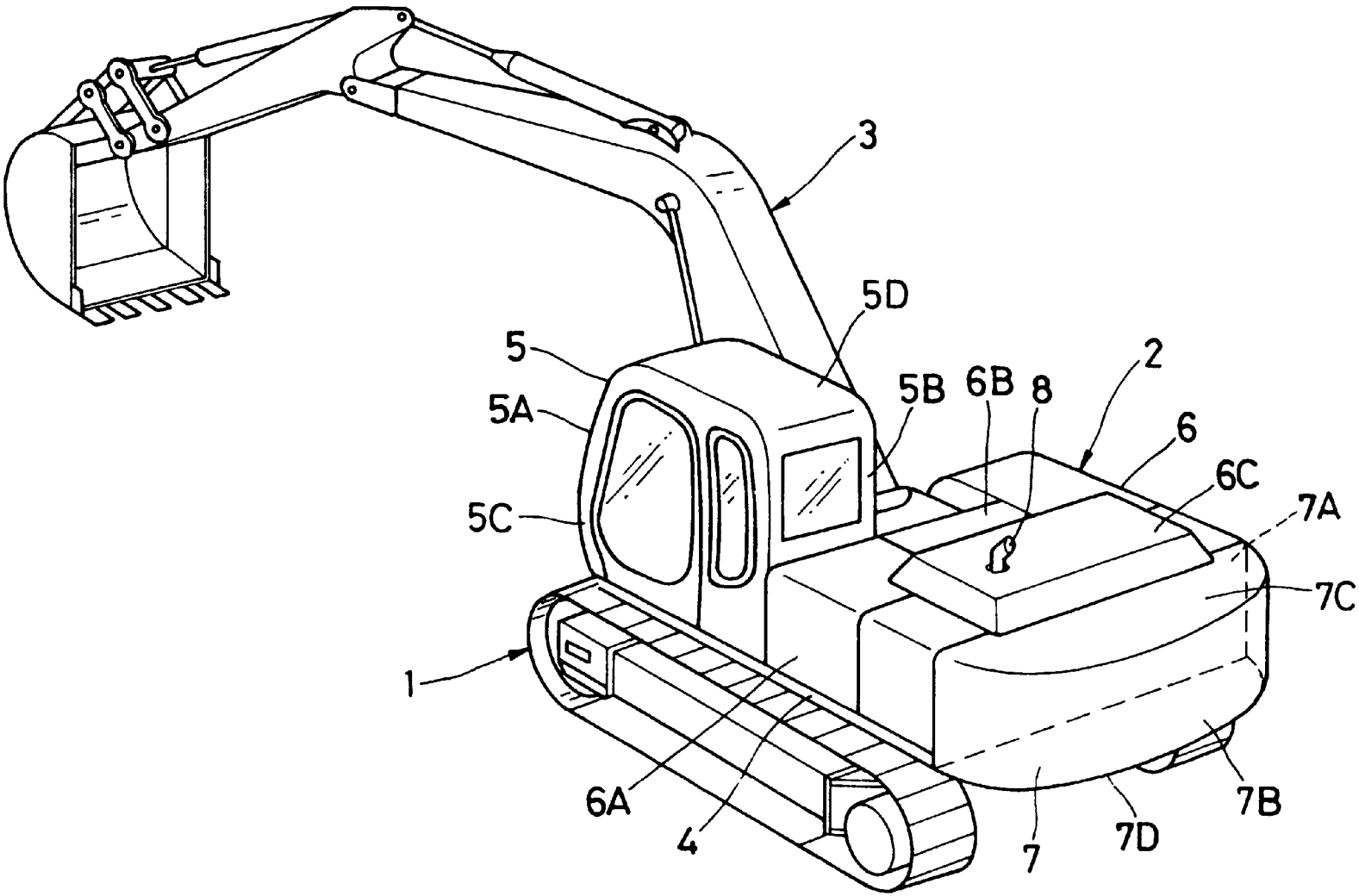
FIG. 1 is a perspective view of a hydraulic power shovel adopted in an embodiment of the present invention.

Hereafter, the rotary type construction machine according to the present invention is described more particularly by way of its preferred embodiments shown in FIGS. 1 through 12, which are applied to a hydraulic power shovel.

In these figures, indicated at 1 is a crawler type self-propelled automotive base carrier and at 2 is an upper rotary body which is rotatably mounted on the self-propelled base carrier 1. Mounted centrally on a front portion of the upper rotary body 2 is a working mechanism 3 which can be lifted up and down when at ground excavating work.

The upper rotary body 2 is largely constituted by a rotary frame 4 of a framework structure on which the working mechanism 3 is mounted to lift loads up and down, a cab 5 which is provided on a left front portion of the rotary frame 4 to serve as an operator's room, an equipment housing cover 6 which is provided on the rotary frame 4 at a position behind the cab 5 to house therein various equipments which are mounted on the rotary frame 4, including an internal combustion engine, radiator, hydraulic pumps, control valves etc. (which are not shown in the drawings), and a counterweight 7 which is provided at the rear end of the rotary frame 4. As shown, an exhaust pipe 8 projects above the equipment housing cover.

Figure 2:
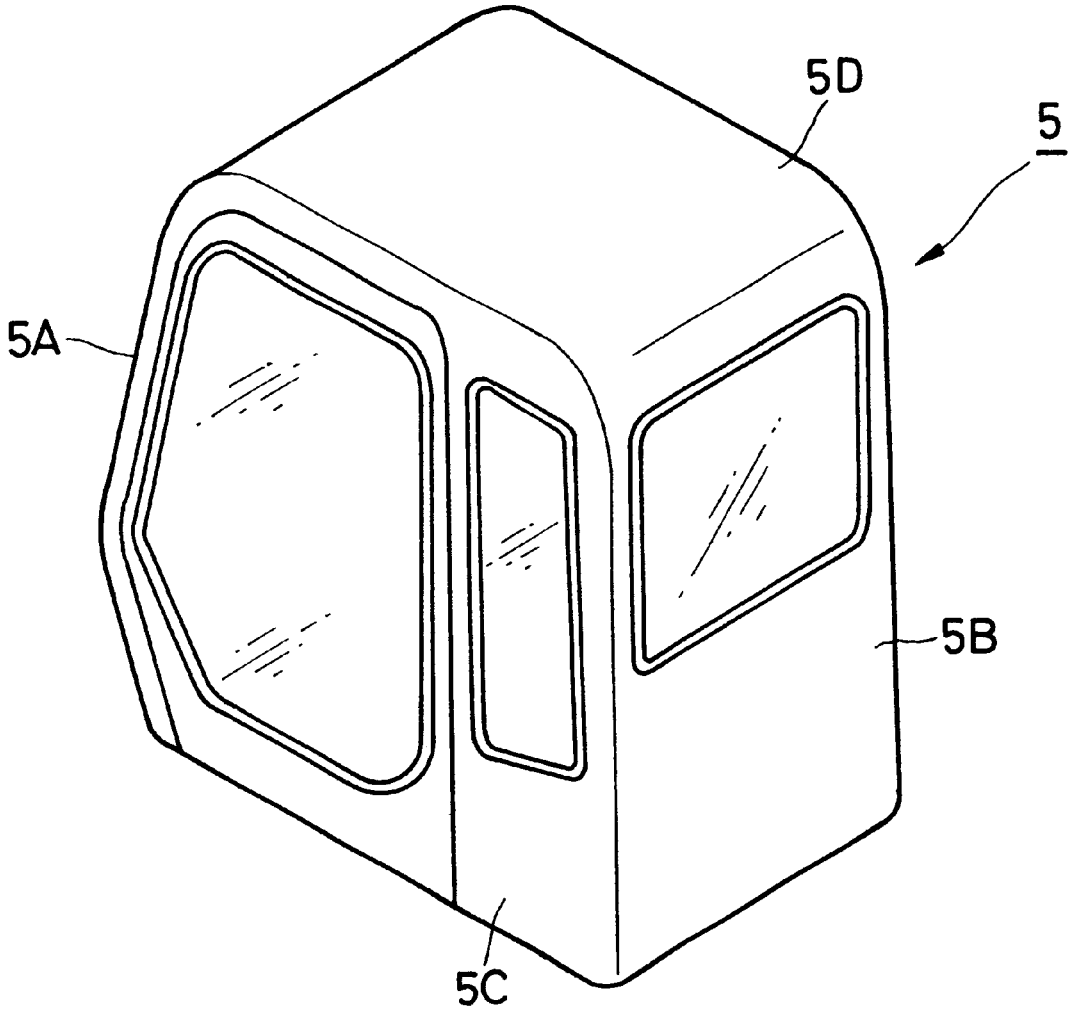
FIG. 2 is a perspective view of a cab adopted in the embodiment of the present invention.

In this instance, as shown in FIG. 2, the cab 5 is formed in a box-like structure having front plate 5A, rear plate 5B and right and left side plates 5C which have vertical outer surfaces, and a top plate 5D which has a horizontal outer surface. The cab 5 internally defines an operator's room and accommodates therein an operator's seat along with other various operation control instrument and devices (all omitted in the drawings).

Figure 3:
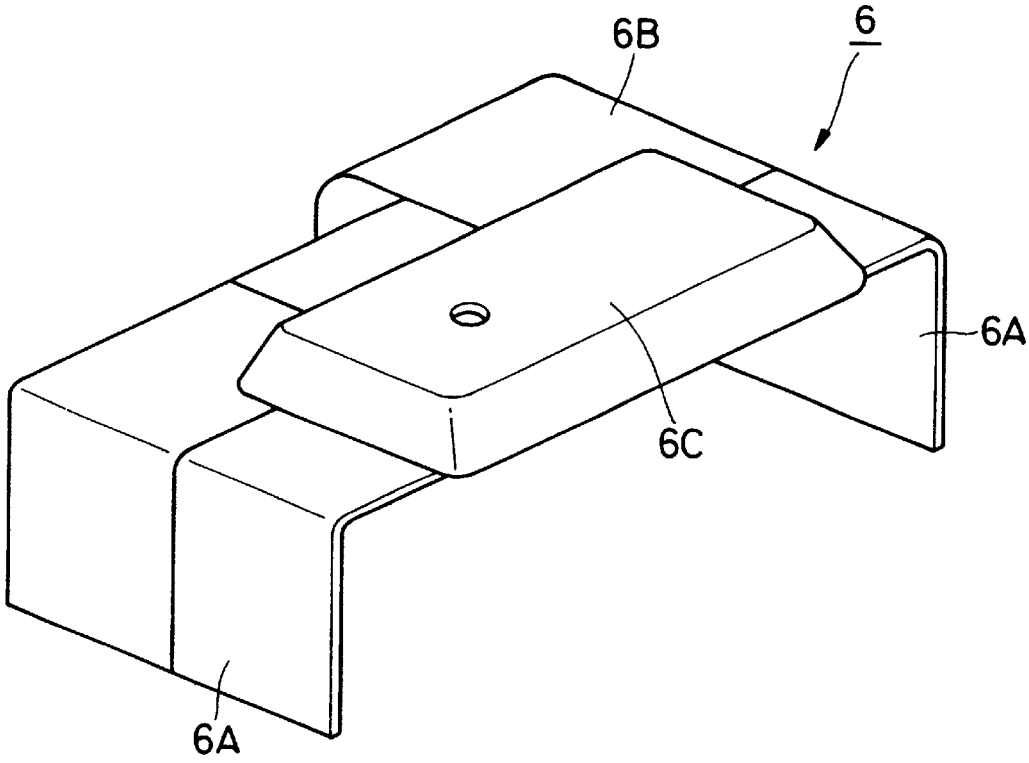
FIG. 3 is a perspective view of an equipment housing cover adopted in the embodiment of the present invention.
Figure 5:
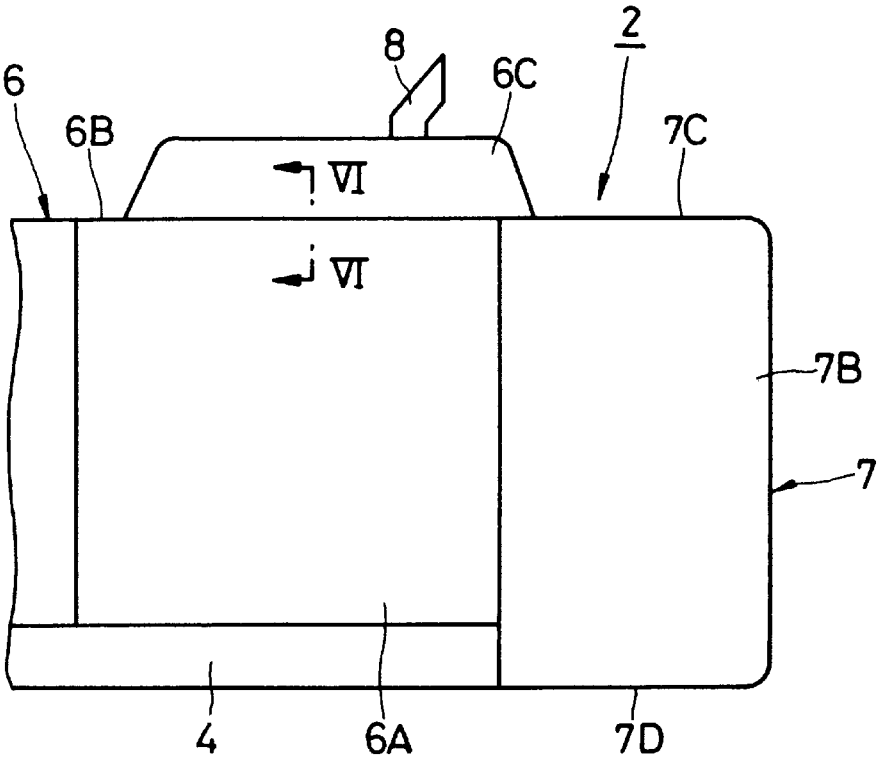
FIG. 5 is a side view on an enlarged scale of the equipment housing cover and the counterweight.

The equipment housing cover 6 is provided on the rotary frame 4 in an intermediate position between the cab 5 and the counterweight 7, and, as shown in FIG. 3, is in the form of a housing structure having right and left side plates 6A with vertical outer surfaces, and a top plate 6B with a horizontal outer surface which is connected to upper ends of the right and left side plates 6A. In a transversely intermediate position, the top plate 6B is provided with a box-like engine cover 6C which can be opened and closed. An exhaust pipe 8 is projected on the Upper side of the top cover 6C, as shown in FIG. 5, to release therethrough exhaust gases of internal combustion engine.

Figure 4:
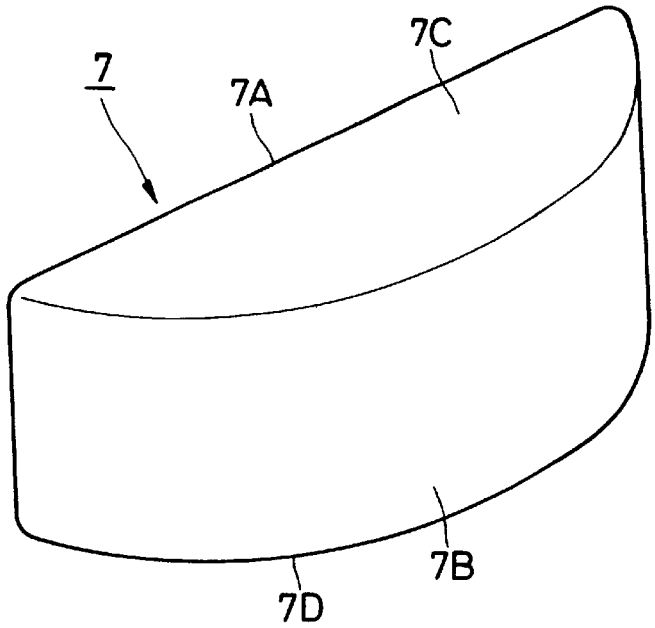
FIG. 4 is a perspective view of a counterweight adopted in the embodiment of the present invention.

Further, as shown in FIG. 4, the counterweight 7, which functions as a weight balance for stabilizing the working mechanism 3, is in the shape of a mass having front and rear sides 7A and 7B with vertical outer surfaces, and upper and lower sides 7C and 7D with horizontal outer surfaces, respectively.

The hydraulic power shovel is provided with a hydrophilic film coating on outer surfaces of the cab 5, equipment housing cover 6 and counterweight 7 of the upper rotary body 2 to prevent deposition of raindrop stains or the like in the manner as will be described hereinafter.

Figure 6:
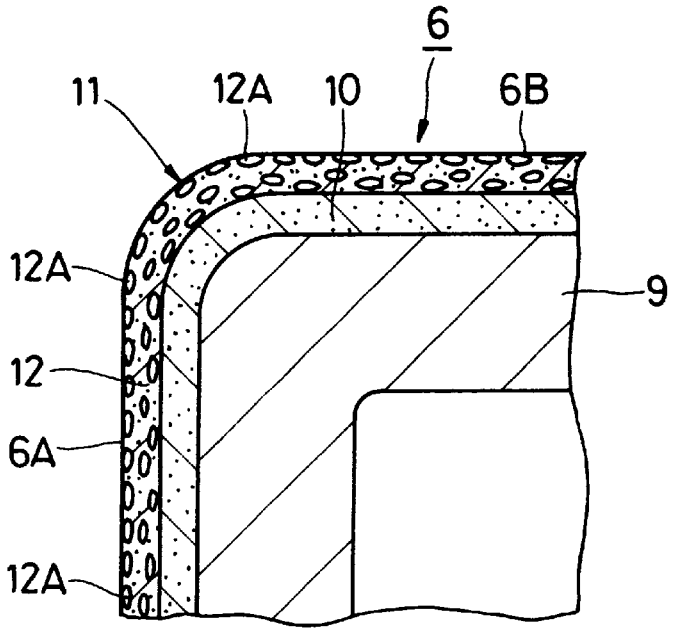
FIG. 6 is a vertical sectional view taken on line VI—VI of FIG. 5 to show a hydrophilic film coating formed on the outer surface of the equipment housing cover.

In this particular embodiment, the hydrophilic film coatings 11 which are provided on the outer surfaces of the cab 5, equipment housing cover 6 and counterweight 7 are of the same nature, so that the hydrophilic film coating 11 on the outer surface of the equipment housing cover 6 alone is described below in detail with reference to FIGS. 5 and 6.

In these figures, indicated at 9 is a steel plate or plates which constitute the equipment housing covet 6, and at 10 is a base or under coat which is formed on the surface of the steel plate 9. The under coat 10 is formed, for example, by applying an anti-corrosive alkyd resin paint or urethane resin paint on the surface of the steel plate 9.

Denoted at 11 is the hydrophilic film coating which is provided on the outer surfaces of the side plates 6A and top plate 6B of the equipment housing cover 6. The hydrophilic film coating is formed by applying a hydrophilic solid paint 12 as a top coat on the surface of the under coat 10. In this instance, as the hydrophilic solid paint 12, there may be employed a hydrophilic polyurethane paint or a hydrophilic fluorine resin paint, e.g., a paint which contains polyurethane- or fluoro resin as a main component along with a curing agent such as isocyanate or the like and a coloring pigment, and which is added with a hydrophilic agent 12A containing such hydrophilic substances as special silicate and a fluorine-based inorganic hydrophilic agent or the like.

Here, the hydrophilic film coating 11 is of such a nature that water drops dwell on its surface with a contacting angle θ2 smaller than 60 degrees, for example, with a contacting angle of about 50 degrees. Therefore, as will be described hereinafter, a water film is quickly formed on the surface of the hydrophilic film coating 11 at the time of rainfall or when sprinkled with wash water to prevent development of raindrop stains.

In addition to the outer surfaces of the equipment housing cover 6, the hydrophilic film coating 11 is formed on outer surfaces of the front and rear plates 5A and 5B and side plates 5C of the cab 5 as well as on outer surfaces of the front and rear sides 7A and 7B and top and bottom sides 7C and 7D of the counterweight 7.

In the rotary type construction machine according to the present embodiment, the hydrophilic film coatings 11 which are formed on outer surfaces of the cab 5, equipment housing cover 6 and counterweight 7 of the upper rotary body 2, function to prevent raindrop stains in the same manner as will be explained below particularly by way of the hydrophilic film coating 11 on the outer surface of the equipment housing cover 6 with reference to FIGS. 7 to 11.

Figure 7:
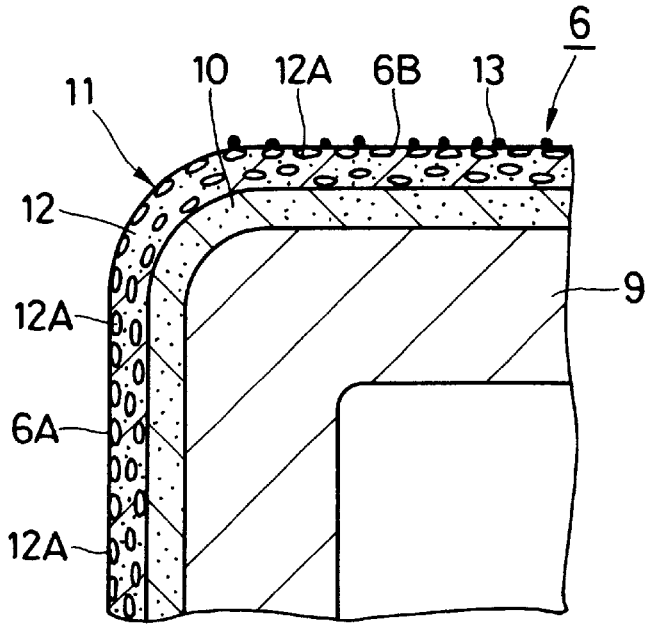
FIG. 7 is a vertical sectional view taken in a position similar to FIG. 6 to show the conditions of contaminant substances deposited on the surface of the hydrophilic film coating.

Firstly, as shown in FIG. 7, fine particles of contaminant substances 13, for example, particles of carbon compounds and/or spattered particles of grease fall on the hydrophilic film coating 11 which covers the outer surface of the top plate 6B of the equipment housing cover 6.

Figure 8:
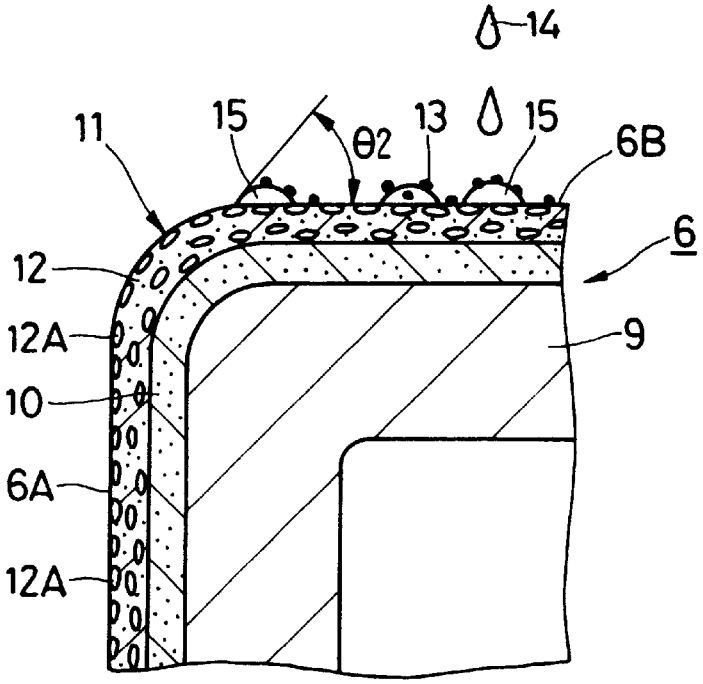
FIG. 8 is a vertical sectional view taken in a position similar to FIG. 6 to show the conditions of water drops dwelling on the surface of the hydrophilic film coating.

Nextly, if it happens to rain, the raindrops 14 which fall on the top plate 6B intimately sit on the hydrophilic film coating 11 in the form of widely spread water drops 15 as shown in FIG. 8, and the particles of contaminant substances 13 tend to float up to the surfaces of the water drops 15. At this time, the water drops 15 temporarily dwell on the hydrophilic film coating 11 with a small contacting angle θ2, for instance, with a contacting angle θ2 of about 50 degrees.

Figure 9:
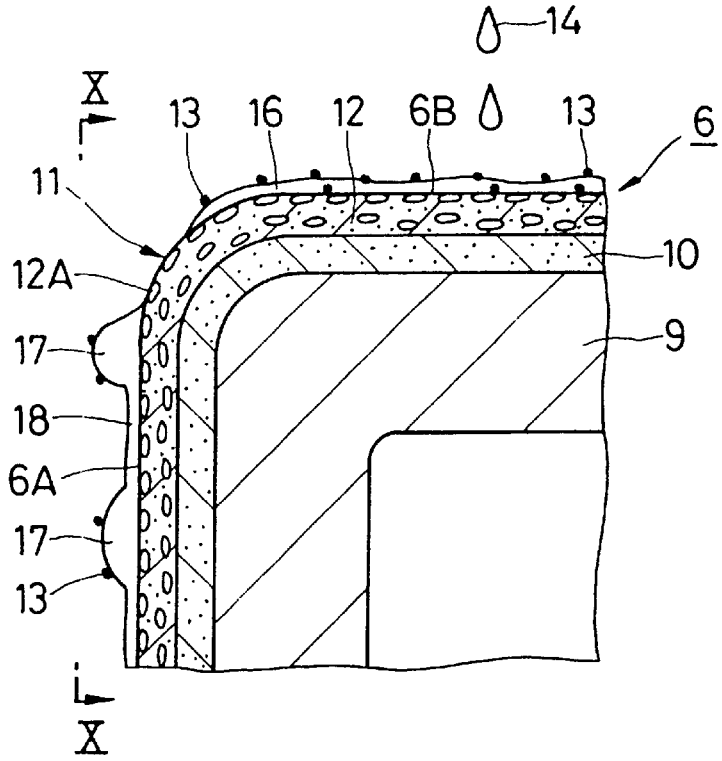
FIG. 9 is a vertical sectional view taken in a position similar to FIG. 6 to show the manner in which contaminant substances flow down along with a water film which is formed on the surface of the hydrophilic film coating.
Figure 10:
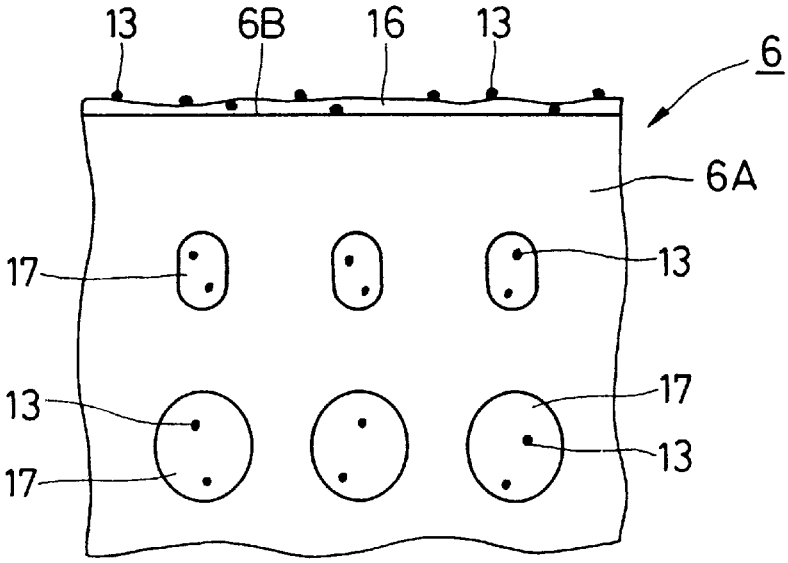
FIG. 10 is a side view taken from the direction of arrow X—X of FIG. 9 to show the manner in which contaminant substances flow down along with a water film which is formed on the surface of the hydrophilic film coating.

Soon the water drops 15 on the hydrophilic film coating 11 are connected with each other to form a water pool 16 as shown in FIGS. 9 and 10. As the water pool 16 grows larger, overflowing water 17 starts dripping from the top plate 6B and flows down along the side plate 6A the floating contaminant substances 13.

At this time, since the outer surface of the side plate 6A is coated with hydrophilic film coating 11, the overflowing water 17 intimately spread over the hydrophilic film coating 11 as they flow down on and along the surface of the side plate 6A, forming a water film 18 on the surface of the hydrophilic film coating 11. Accordingly, the contaminant substances 13 which float on the surface of the water film 18 is carried away with dripping water which flows down in the form of the water film 18, thereby preventing from the deposition on the surface of the side plate 6A.

Figure 11:
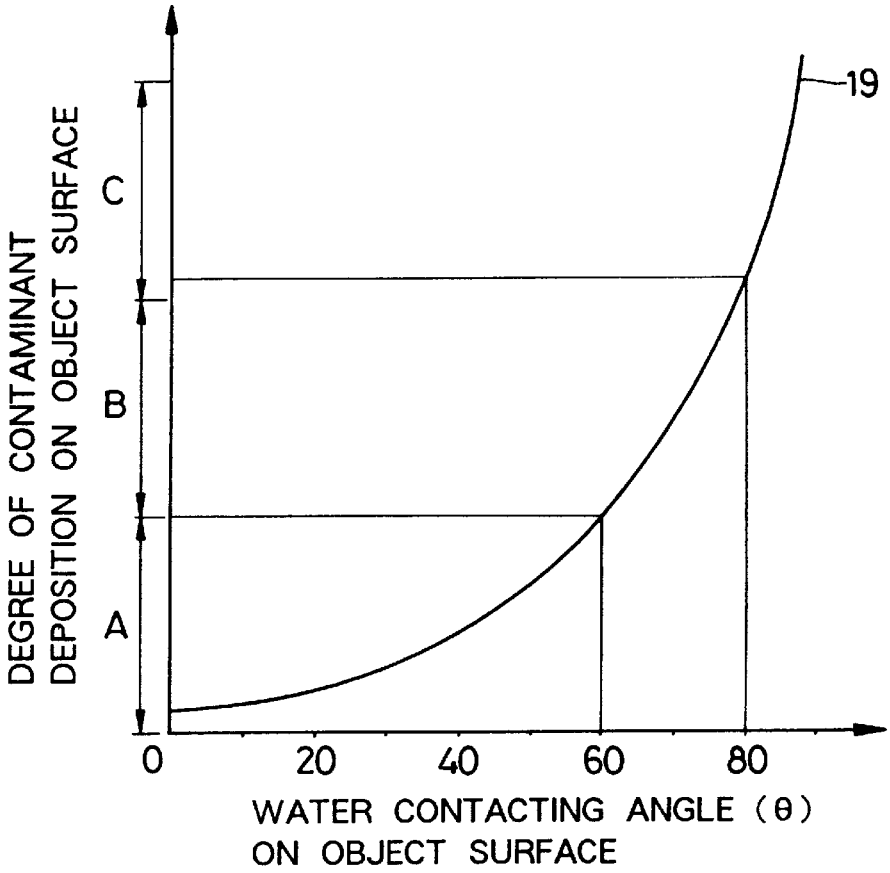
FIG. 11 is a characteristics diagram showing the relationship between water contacting angle on the surface of an object and degree of contaminant deposition.

In this regard, FIG. 11 shows the relationship between the water contacting angle θ on a surface of an object and the degree of deposition of contaminant substances on the object.

In the diagram of FIG. 11, the water contacting angle θ of an object surface and the degree of contaminant deposition on that surface are plotted against the horizontal and vertical axes, respectively. The degree of contaminant deposition in indicated by way of three ranges, i.e., a range A in which the object surface is barely contaminated, a range B in which the object surface is contaminated a little, and a range C in which the object surface is conspicuously contaminated. As indicated by a characteristics curve 19 in FIG. 11, the degree of contaminant deposition remains in the range A, namely, the object surface remains almost in an uncontaminated state as long as the contacting angle θ is smaller than 60 degrees. Accordingly, as compared the conventional upper rotary body which suffers from conspicuous deposition of contaminants on its top coat 111 with a water contacting angle θ1 larger than 80 degrees, the upper rotary body according to the present embodiment of the invention, with the hydrophilic film coating 11 with a water contacting angle θ2 smaller than 60 degrees (e.g., θ2=50 degrees), remains immune from contaminant deposition.

According to the present embodiment as described above, the hydrophilic film coating 11, with a water contacting angle θ2 smaller than 60 degrees, is formed on the outer surfaces of the equipment housing cover 6 thereby to effectively prevent development of raindrop stains on the side plates 6A of the equipment housing cover 6. Even if contaminant particles such as spattered particles of grease happen to deposit on the outer surface of the equipment housing cover 6, the particles of this sort are urged to float up on a water film which is formed on the hydrophilic film coating 11 upon sprinkling wash water thereon or at the time of rainfall, and therefore they can be easily removed as the floating particles are readily washed away with wash water.

Thus, the hydrophilic film coating 11 which is formed on the outer surfaces of the cab 5, equipment housing cover 6 and counterweight 7 contributes to keep the outer surfaces of these components always in a clean state, and to maintain the quality in outer appearance of the upper rotary body 2.

Figure 12:
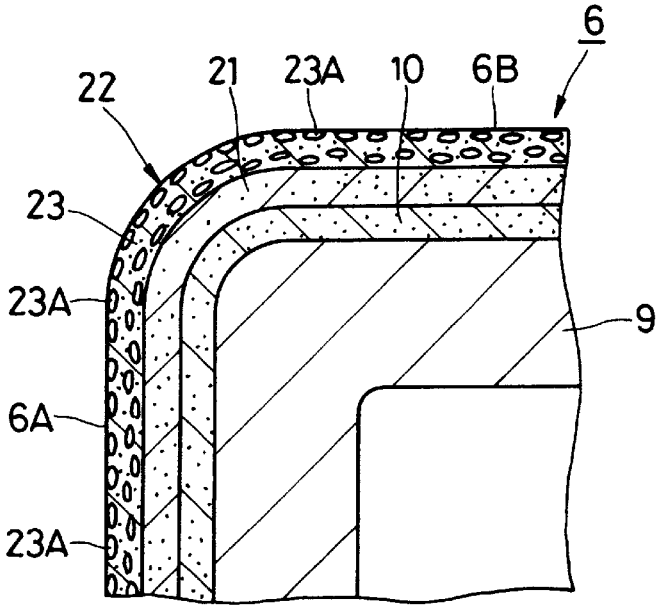
FIG. 12 is a vertical sectional view taken in a position similar to FIG. 6 but showing a modification of the hydrophilic film coating.
Figure 13:
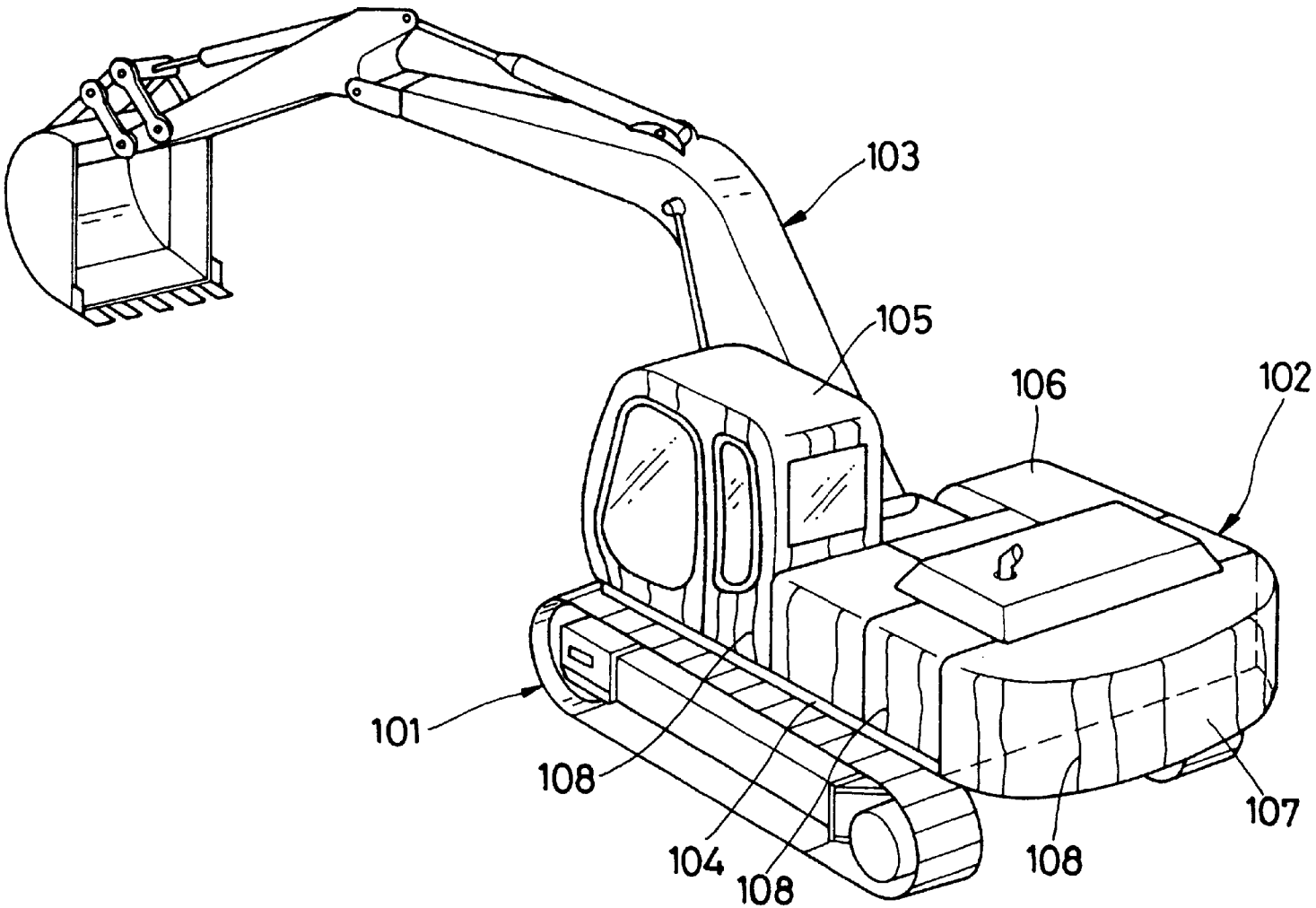
Fig. 13 PRIOR ART
FIG. 13 is a perspective view of a hydraulic power shovel shown as an example of rotary type construction machine by prior art.
Figure 14:
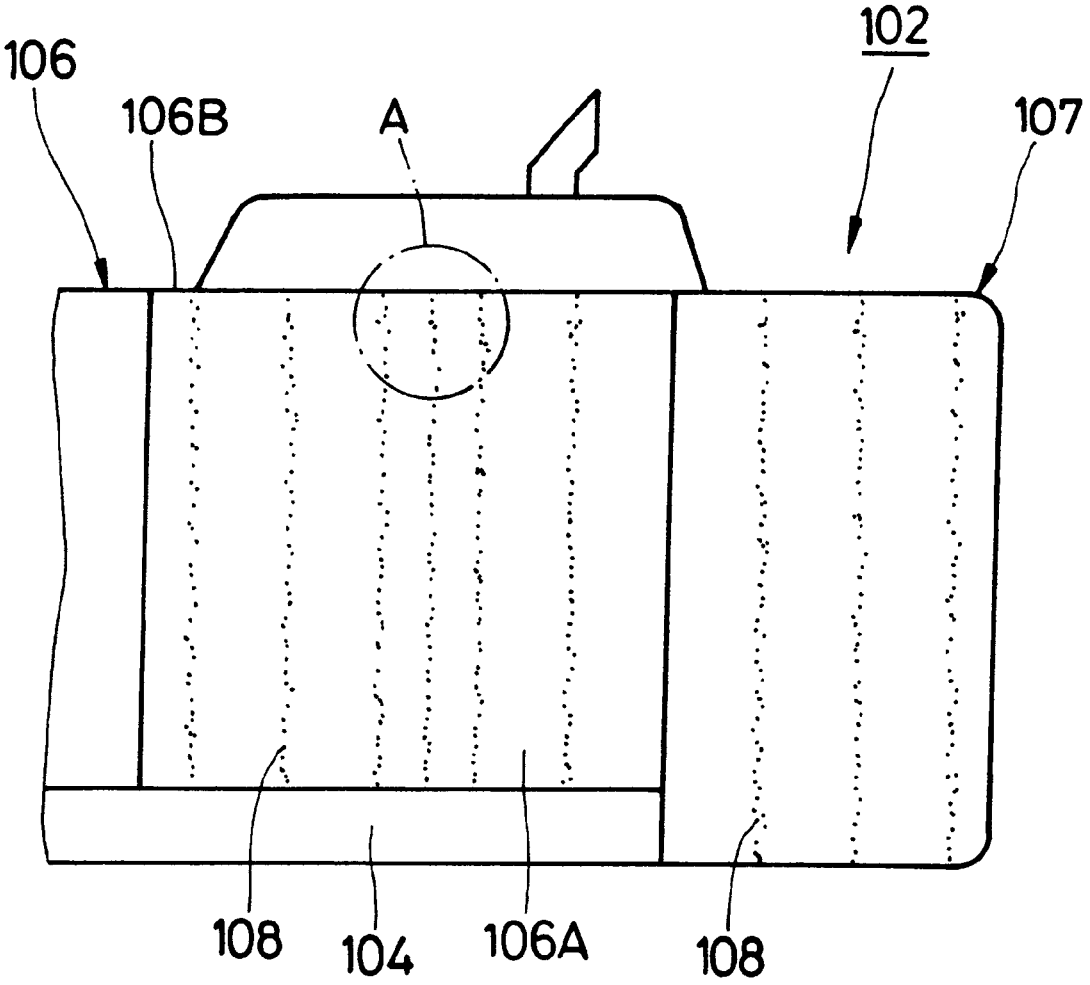
Fig. 14 PRIOR ART
FIG. 14 is a side view on an enlarged scale of equipment housing cover and counterweight shown in FIG. 13.
Figure 15:
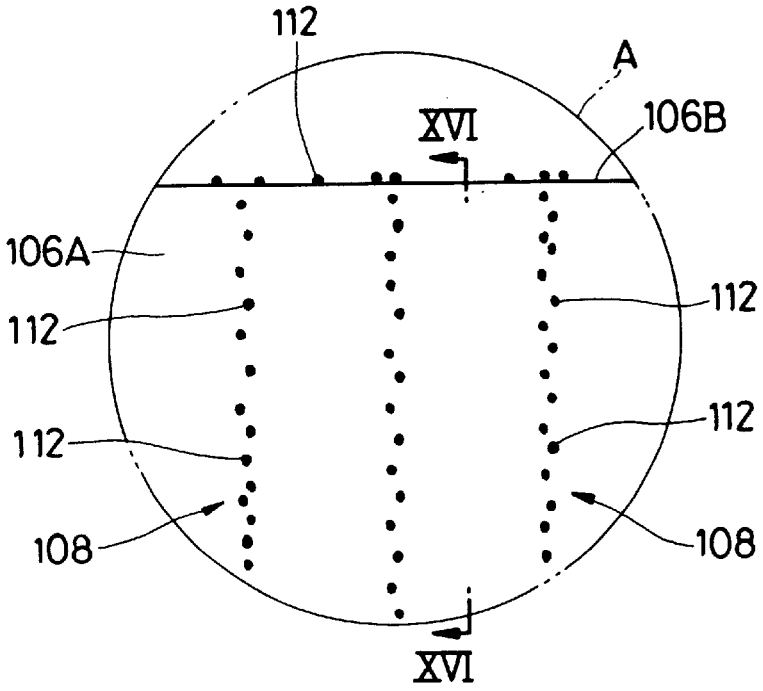
Fig. 15 PRIOR ART
FIG. 15 is an enlarged view of an encircled portion A in FIG. 14.
Figure 16:
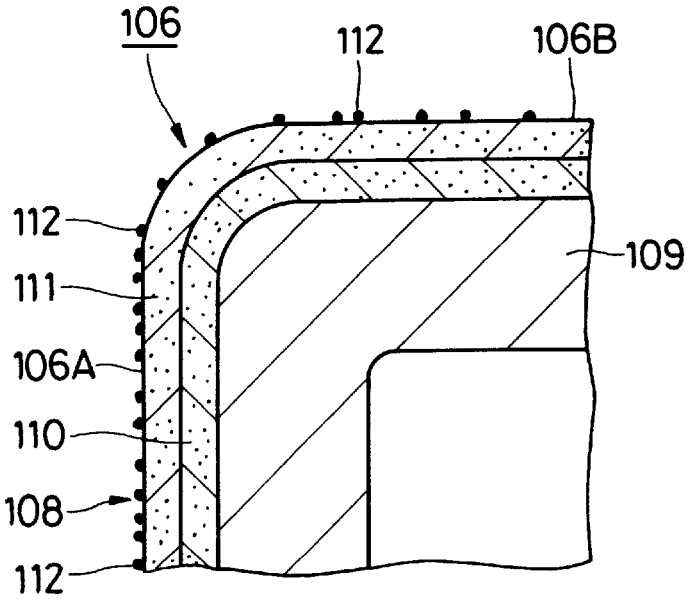
Fig. 16 PRIOR ART
FIG. 16 is a vertical sectional view taken from the direction of arrow XVI—XVI of FIG. 15 to show a paint film coating provided on the conventional equipment cover.
Figure 17:
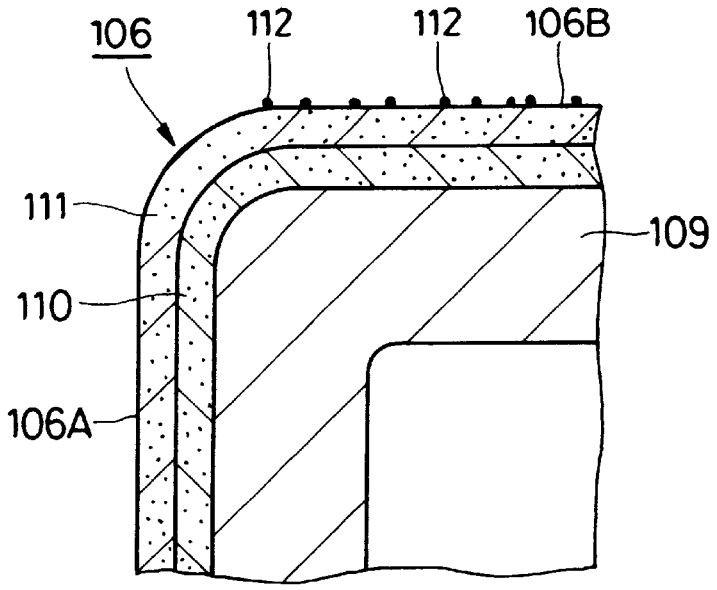
Fig. 17 PRIOR ART
FIG. 17 is a vertical sectional view taken in a position similar to FIG. 16 to show the conditions of contaminant substances deposited on the outer surface of the equipment housing cover.
Figure 18:
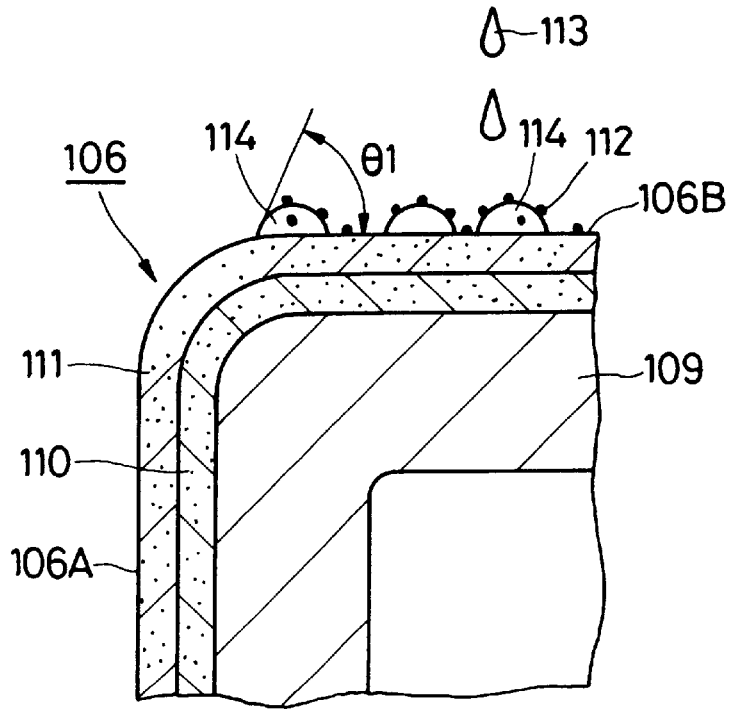
Fig. 18 PRIOR ART
FIG. 18 is a vertical sectional view taken in a position similar to FIG. 16 to show the conditions of water drops dwelling on the outer surface of the equipment housing cover.
Figure 19:
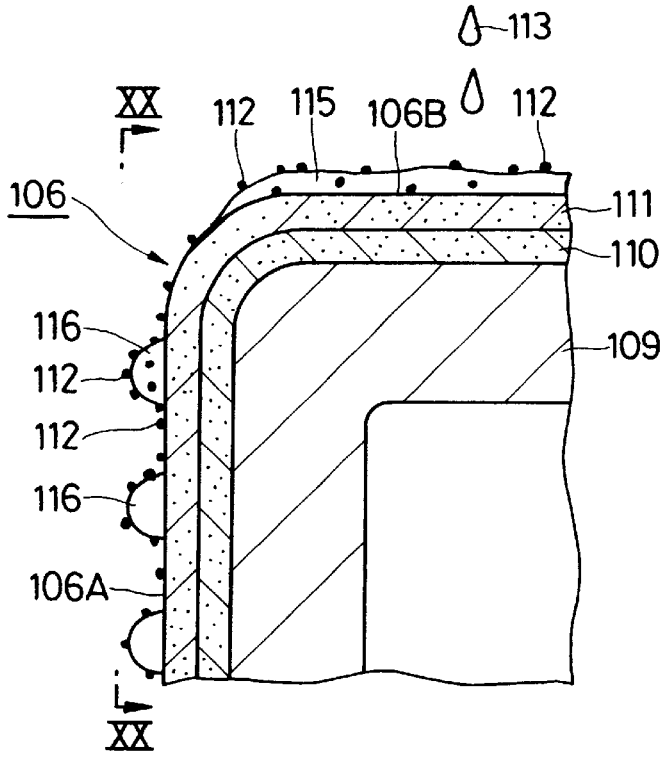
Fig. 19 PRIOR ART
FIG. 19 is a vertical sectional view taken in a position similar to FIG. 16 to show the conditions of contaminant substances deposited on the outer surface of the equipment housing cover.
Figure 20:
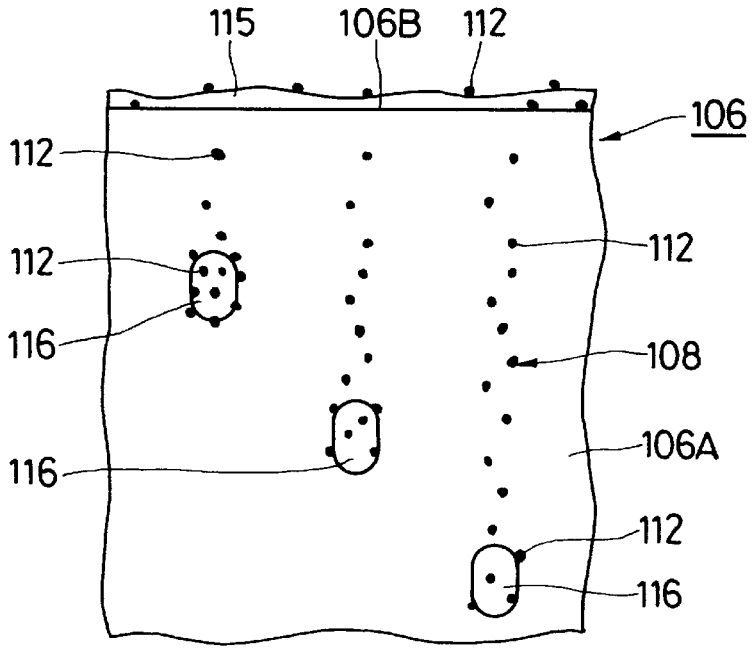
Fig. 20 PRIOR ART
FIG. 20 is a side view taken from the direction of arrow XX—XX of FIG. 19 to show the conditions of contaminant substances deposited on the outer surface of the equipment housing cover.

Referring now to FIG. 12, there is shown a modification of the hydrophilic film coating. In the following description of the modification, those component parts which are common with the foregoing embodiment are simply designated by common reference numerals or characters to avoid repetitions of same explanations.

In FIG. 12, indicated at 21 is a first top coat which is formed on an under coat 10. The first top coat 21 is of a solid paint which contains acrylic resin, polyurethane or the like as a main component, along with a curing agent such as isocyanate and a coloring pigment. The first top coat 21 is formed of a solid paint of this sort which in applied on the surface of the under coat 10.

Denoted at 22 is a hydrophilic film coating which is provided on the outer surfaces of the equipment housing cover 6. The hydrophilic film coating 22 is provided on the surface of the first top coat 21 which is coated on the under coat 10. The hydrophilic film coating 22 is formed by applying a hydrophilic clear paint 23 on the surface of the first top coat 21. In this instance, for example, the hydrophilic clear paint 23 may be a transparent hydrophilic polyurethane clear paint or a fluoro resin clear paint which contains polyurethane or a fluorine resin as a main component along with a curing agent such as isocyanate or the like, and added with a hydrophilic agent 23A containing special silicate and a fluorine-based inorganic hydrophilic agent or the like.

Similarly to the hydrophilic film coating 11 in the foregoing first embodiment, the hydrophilic film coating 22 on the above-described modification is of such a nature that water drops dwell on its surface with a small contacting angle, for example, with a contacting angle smaller than 60 degrees, and a water film is quickly formed on its surface at the time of rainfall or when sprinkled with wash water to float up and wash away deposited contaminant particles along with the water film form by rain water or sprinkled wash water.

As a consequence, the outer surfaces of the cab 5, equipment housing cover 6 and counterweight 7 which are provided with the hydrophilic film coating 22 can be always kept in a clean state and can retain the original quality in outer appearance of the upper rotary body 2 for a prolonged period of time.

Although the present invention has been described by way of a rotary type construction machine in the foregoing embodiments, it is to be understood that the invention can be similarly applied to other rotary type construction machines, for example, such as hydraulic cranes or the like.

Further, in the foregoing embodiments, the hydrophilic film coating 11 is provided on all of the front and rear plates 5A and 5B, side plates 5C and top plate 5D of the cab 5, the right and left side plates 6A, top plate 6B and engine cover 6C of the equipment housing cover 6 and the front and rear sides 7A and 7B and top and bottom sides 7C and 7D of the counterweight 7. However, the present invention is not limited to the particular example shown. Namely, for example, the hydrophilic film coating 11 may be provided only on those portions which have vertical surfaces, including the front and rear plates 5A and 5B and right and left side plates 5C of the cab 5, the side plates 6A of the equipment housing cover 6, and the rear side 7B of the counterweight 7.

Furthermore, the counterweight 7 in the foregoing embodiments is of a sectoral shape having outer surfaces on the front and rear sides 7A and 7B and on the top and bottom sides 7C and 7D. However, the present invention is not limited to this particular form of counterweight and can be likewise applied to counterweight of other forms, for example, to a counterweight which has vertical lateral side surfaces between the front and rear sides 7A and 7B.

INDUSTRIAL APPLICABILITY

As clear from the foregoing particular description, according to the present invention, a hydrophilic film coating is formed on outer surfaces of a rotary body of a construction machine or on outer surfaces of the cab, equipment housing cover and counterweight which constitute a rotary body of a construction machine, so that raindrops or sprinkled wash water falling on the rotary body dwells on the hydrophilic film coating in intimate contact therewith, thereby forming a water film on the surface of the hydrophilic film coating, thereby floating up contaminants which have deposited on the outer surfaces of the rotary body and making it possible to remove such contaminants quite easily. Accordingly, the outer surfaces of the rotary body can be kept always in a clean state, thereby permitting to maintain the quality in outer appearance of the rotary type construction machine effortlessly.

Further, according to the present invention, the hydrophilic film coating is provided at least on vertical surfaces of the rotary body, so that oily contaminants which have deposited on the outer surface of the rotary body can be removed along with dripping water which forms a water film as it flows down along vertical outer surfaces of the rotary body.

Furthermore, according to the present invention, the hydrophilic film coating is formed by coating a hydrophilic agent which is capable of forming a water film on a coated surface to float up and wash away contaminants with the water film, so that the hydrophilic film coating can be easily formed simply by adding the hydrophilic agent into a paint to be coated on the surfaces of the rotary body.

Moreover, according to the present invention, the hydrophilic film coating is constituted by a film which has a water contacting angle smaller than 60 degrees, so that it can form a water film on its surface in an accelerated manner to wash away contaminant particles with the water film at the time of rainfall or when sprinkled with wash water.

Further, according to the present invention, the hydrophilic film coating is constituted by a coating film which is formed by application of a paint containing a hydrophilic agent as an additive, so that the hydrophilic film coating can be easily formed simply by admixing the hydrophilic agent into a paint to be coated on a rotary body of a construction machine or the like.

Furthermore, according to the present invention, the hydrophilic film coating can be easily formed on outer surfaces of a rotary body of a construction machine or the like simply by admixing a hydrophilic agent into a solid paint to be applied as a top coat on the surface of an under coat formed on the rotary body.

Moreover, according to the present invention, the hydrophilic film coating can also be formed on outer surfaces of a rotary body of a construction machine or the like simply by admixing a hydrophilic agent into a clear paint to be applied as a top coat on the surface of an under coat formed on the rotary body. Accordingly, even in the case of a rotary body which already has an ordinary coating film on its outer surfaces, the hydrophilic film coating can be formed afterwards by coating thereon a clear paint which contains a hydrophilic agent.

What is claimed is:

1. A rotary type construction machine having a self-propelled base carrier, a rotary body rotatably mounted on said base carrier, an internal combustion engine mounted on said rotary body and being housed in an equipment housing cover and having an exhaust pipe projected above said equipment housing cover, and a working mechanism mounted on said rotary body for lift-up and lift-down motions, said rotary type construction machine comprising:

an under coat formed on outer surface of said rotary body by coating a paint thereon; and a hydrophilic film coating formed on said under coat of said rotary body by coating a hydrophilic paint thereon which covers an entire surface of said under coat, said hydrophilic film coating forming a water film on said outer surface of said rotary body so as to enable oily contaminant substances from said internal combustion engine and said working mechanism deposited on said outer surfaces to flow down along said water film at least in response to rainfall.

2. A rotary type construction machine according to claim 1, wherein the oily contaminant substances from at least said internal combustion engine are exhausted through the exhaust pipe projected above said equipment housing cover and are deposited on said outer surfaces dnd wherein at least in response to rainfall, the deposited oily contaminant substances at least flow down along vertical surfaces of said outer surfaces without leaving streaky stains thereon.

3. A rotary type construction machine according to claim 1, wherein said hydrophilic paint is one of a hydrophilic polyurethane paint and a hydrophilic fluorine resin paint.

4. A rotary type construction machine having a self-propelled base carrier, a rotary body rotatably mounted on said base carrier, an internal combustion engine mounted on said rotary body and being housed in an equipment housing cover and having an exhaust pipe projected above said equipment housing cover, a cab provided on said rotary body and defining an operating room, and a working mechanism mounted on said rotary body for lift-up and lift-down motions, said rotary type construction machine comprising:

an under coat formed on outer surfaces of said cab by coating a paint thereon; and a hydrophilic film coating formed on said under coat of said cab by coating a hydrophilic paint thereon which covers an entire surface of said under coat, said hydrophilic film coating forming a water film on said outer surfaces of said cab so as to enable oily contaminant substances from said internal combustion engine and said working mechanism deposited on said outer surfaces to flow down along said water film at least in response to rainfall.

5. A rotary type construction machine according to claim 4, wherein the oily contaminant substances from at least said internal combustion engine are exhausted through the exhaust pipe projected above said equipment housing cover and are deposited on said outer surfaces, and wherein at least in response to rainfall, the deposited oily contaminant substances at leant flow down along vertical surfaces of said outer surfaces without leaving streaky stains thereon.

6. A rotary type construction machine according to claim 4, wherein said hydrophilic paint is one of a hydrophilic polyurethane paint and a hydrophilic fluorine resin paint.

7. A rotary type construction machine having a self-propelled base carrier, a rotary body rotatably mounted on said base carrier, an internal combustion engine mounted on said rotary body and being housed in an equipment housing cover and having an exhaust pipe projected above said equipment housing cover, and a working mechanism mounted on said rotary body for lift-up and lift-down motions, said rotary type construction machine comprising:

an under coat formed on outer surfaces of said equipment housing cover by coating a paint thereon; and a hydrophilic film coating formed on said under coat of said equipment housing cover by coating a hydrophilic paint thereon which covers an entire surface of said under coat, said hydrophilic film coating forming a water film on said outer surfaces of said equipment housing cover so as to enable oily contaminant substances from said internal combustion engine and said working mechanism deposited on said outer surfaces to flow down along said water film at least in response to rainfall.

8. A rotary type construction machine according to claim 7, wherein the oily contaminant substances from at least said internal combustion engine are exhausted through the exhaust pipe projected above said equipment housing cover and are deposited on said outer surfaces, and wherein at least in response to rainfall, the deposited oily contaminant substances at least flow down along vertical surfaces of said outer surfaces without leaving streaky stains thereon.

9. A rotary type construction machine according to claim 7, wherein said hydrophilic paint is one of a hydrophilic polyurethane paint and a hydrophilic fluorine resin paint.

10. A rotary type construction machine having a self-propelled base carrier, a rotary body rotatably mounted on said base carrier, an internal combustion engine mounted on said rotary body and being housed in an equipment housing cover and having an exhaust pipe projected above said equipment housing cover, a working mechanism mounted on said rotary body for lift-up and lift-down motions, and a counter-weight provided on a rear side of said rotary body, said rotary type construction machine comprising:

an under coat formed on outer surfaces of said counter-weight by coating a paint thereon; and a hydrophilic film coating formed on said under coat of said counterweight by coating a hydrophilic paint thereon which covers an entire surface of said under coat, said hydrophilic film coating forming a water film on said outer surfaces of said counterweight so as to enable oily contaminant substances from said internal combustion engine and said working mechanism deposited on said outer surfaces to flow down along said water film at least in response to rainfall.

11. A rotary type construction machine according to claim 10, wherein the oily contaminant substances from at least said internal combustion engine are exhausted through the exhaust pipe projected above said equipment housing cover and are deposited on said outer surfaces, and wherein at least in response to rainfall, the deposited oily contaminant substances at least flow down along vertical surfaces of said outer surfaces without leaving streaky stains thereon.

12. A rotary type construction machine according to claim 10, wherein said hydrophilic paint is one of a hydrophilic polyurethane paint and a hydrophilic fluorine resin paint.

13. A cab mounted on a rotary frame of a rotary type construction machine and formed in a cab cover structure having front and rear plates, right and left side plates and a top plate, said cab comprising:

an under coat formed at least on outer surfaces of said front and rear plates and said right and left side plates of said cab cover by coating a paint thereon; and a hydrophilic film coating formed on said under coat of said cab cover by coating a hydrophilic paint thereon which covers an entire surface of said under coat, said hydrophilic film coating forming a water film on said outer surfaces of said cab cover structure so as to enable oily contaminant substances deposited on said outer surfaces to flow down along said water film at least in response to rainfall.

14. A cab according to claim 13, wherein at least in response to rainfall, the deposited oily contaminant substances at least flow down along vertical surfaces of said outer surfaces without leaving streaky stains thereon.

15. A cab according to claim 13, wherein said hydrophilic paint is one of a hydrophilic polyurethane paint and a hydrophilic fluorine resin paint.

16. An equipment housing cover for use on a rotary type construction machine, said equipment housing cover being mounted on a rotary frame and formed in a housing structure including at least right and left side plates and a top plate provided between upper ends of said side plates, said equipment housing cover comprising:

an under coat formed at least on outer surfaces of said right and left side plates by coating a paint thereon; and a hydrophilic film coating formed on said under coat of said equipment housing cover plates by coating a hydrophilic paint thereon which covers an entire surface of said under coat, said hydrophilic film coating forming a water film on said outer surfaces of said housing structure so as to enable oily contaminant substances deposited on said outer surfaces to flow down along said water film at least in response to rainfall.

17. An equipment housing cover according to claim 16, wherein at least in response to rainfall, the deposited oily contaminant substances at least flow down along vertical surfaces of said outer surfaces without leaving streaky stains thereon.

18. An equipment housing cover according to claim 16, wherein said hydrophilic paint is one of a hydrophilic polyurethane paint and a hydrophilic fluorine resin paint.

19. A counter-weight for use on a rotary frame of a rotary type construction machine and constituted by a mass having front, rear, top and bottom side surfaces, said counterweight comprising:

an under coat formed at least on said rear side surface of said counterweight by coating a paint thereon; and a hydrophilic film coating formed on said under coat of said rear side surface by coating a hydrophilic paint thereon which covers an entire surface of said under coat, said hydrophilic film coating forming a water film on said rear side surface of said counterweight so as to enable oily contaminant substances deposited on said rear side surface to flow down along said water film at least in response to rainfall.

20. A counter-weight according to claim 19, wherein at least in response to rainfall, the deposited oily contaminant substances at least flow down along vertical surfaces of said rear side surfaces without leaving streaky stains thereon.

21. A counter-weight according to claim 19, wherein said hydrophilic paint is one of a hydrophilic polyurethane paint and a hydrophilic fluorine resin paint.

* * * * *